United States Patent [19]

Roser et al.

[11] Patent Number: 4,660,783

[45] Date of Patent: Apr. 28, 1987

[54] YARN BRAKE, PARTICULARLY FOR TEXTILE MACHINES

[75] Inventors: Erich Roser, Bermatingen; Gustav Memminger, Heideweg 65, D-7290 Freudenstadt, both of Fed. Rep. of Germany

[73] Assignee: Gustav Memminger, Freudenstadt, Fed. Rep. of Germany

[21] Appl. No.: 785,527

[22] Filed: Oct. 8, 1985

[30] Foreign Application Priority Data

Oct. 11, 1984 [DE] Fed. Rep. of Germany ..... 3437251

[51] Int. Cl.[4] ..... B65H 59/16

[52] U.S. Cl. ..... 242/155 R; 242/45; 242/47.01

[58] Field of Search ..... 242/155 R, 155 M, 45, 242/47.01

[56] References Cited

U.S. PATENT DOCUMENTS

| | | | |
|---|---|---|---|
| 1,981,133 | 11/1934 | Waters | 242/45 |
| 2,343,461 | 3/1944 | Knaus et al. | 242/45 |
| 2,569,342 | 9/1951 | Scott | 242/45 |
| 2,605,055 | 7/1952 | Scott et al. | 242/45 |
| 2,764,367 | 9/1956 | Brey | 242/155 R |
| 3,112,897 | 12/1963 | Eshbaugh et al. | 242/45 |

FOREIGN PATENT DOCUMENTS

| | | | |
|---|---|---|---|
| 1913720 | 2/1965 | Fed. Rep. of Germany . | |
| 884075 | 12/1961 | United Kingdom | 242/155 R |

OTHER PUBLICATIONS

Article in Melliand Publication, vol. 38, 2nd Issue, 1957, pp. 202–205, by Dipl.-Ing. B. Hoehl, Entitled "Winding Problems in the Textile Industry".

*Primary Examiner*—Stanley N. Gilreath

*Attorney, Agent, or Firm*—Frishauf, Holtz, Goodman, Woodward

[57] ABSTRACT

A yarn brake, particularly for textile machines, has a pivoted, low-inertia yarn drum that is wrapped several times by yarn in a slip-free manner in a yarn contact section and is non-rotatably secured to a low-inertia armature of a controllable electric motor which is driven by the moving yarn against its impressed sense of rotation.

14 Claims, 4 Drawing Figures

YARN BRAKE, PARTICULARLY FOR TEXTILE MACHINES

The invention relates to a yarn brake, particularly for textile machines, with a rotatable yarn drum about which yarn is wrapped several times in a slip-free manner on a yarn contact section. An electromagnetically functioning braking device is non-rotatably secured to the drum. The braking torque acting upon the drum can be particularly well adjusted and controlled.

BACKGROUND

A yarn brake for knitting and spooling machines, as is known from the German Utility Model No. 1 913 720. In this apparatus the braking device is designed in the form of a braking magnet acting upon a metallic yarn winding drum. The magnetic flux of this magnet passes through parts of the drum and is adjustable and controllable. The magnetic field can be influenced either by changing the exciting current of the magnet, which is an electromagnet, or by introducing a metallic element into the air gap between the pole faces of the magnet and the yarn drum. The metallic element more or less diverts the magnetic flux. It is necessary for the yarn drum either to consist completely of a magnetically conductive material such as iron, or to have at least magnetically conductive disk or ring-shaped components to achieve the magnetic braking action. In both cases, the yarn drum will have a relatively big inertia, resulting in a strong flywheel effect because on the one hand magnetically conductive components are essential, and on the other hand a certain minimum diameter is necessary to produce in the area of one drum face a magnetic return for the braking magnets, with a sufficiently high reluctance so that appropriate magnetic induction in the drum components through which the magnetic flux passes.

However, the considerable flywheel effect of the yarn drum renders such a yarn brake useless for all those applications where rapid changes in the speed of yarn travel must be expected. The heavy yarn drum, coupled in a slip-free manner with the moving yarn, cannot follow rapid changes in the speed of yarn travel, with the result that the yarn is either subject to tension peaks or to a collapse in yarn tension, both of which are inadmissible.

Apart from those considerations, the braking effect produced by the stationary braking magnets in the rotational magnetically conductive yarn drum is based on eddy current effects and is very dependent on the speed. Especially at low yarn travel speeds the braking effect drops quickly below an admissible minimum rate.

For practical purposes it is therefore always necessary to go back to disk or ball-type yarn brakes in which the yarn is pulled, frictionally engaged, between two braking surfaces which assert a certain braking force upon it. But with these it is usually unavoidable that sensitive yarns are more or less undesirably affected, while on the other hand the braking effect that can be achieved at low yarn travel speeds is also problematic.

All yarn brakes mentioned above are unable to establish or maintain a definite tension in stationary yarn.

THE INVENTION

It is an object to provide a yarn brake with which it is possible to brake the yarn gently, i.e. without exerting abrasive friction upon its surface, at exactly predetermined rates in such a way that a predetermined yarn tension is maintained even at low or minute yarn travel speeds, and which can be operated without much additional expense even for applications where rapid changes in yarn travel speeds can be expected from time to time.

Briefly, a low-inertia yarn drum is coupled with a low-inertia armature of a controllable electric motor that can be driven counter to its impressed sense of rotation by the moving yarn.

Since the small electric motor is driven counter to the impressed sense of rotation by the yarn that is to be braked, the motor exerts its braking torque not only when the yarn is moving rapidly, but also when the yarn travel speed becomes very low or when the yarn comes to a standstill altogether. Should during a standstill in the yarn supply the yarn tension in a yarn distributor decrease rapidly for a while, as is frequently the case, the yarn brake will automatically rewind the slack piece of yarn between yarn drum and distributor and thus restore the predetermined yarn tension.

The electric motor driving the yarn drum could actually be of any suitable design that allows it to produce a braking torque within the appropriate tolerance range in each applicable speed range. But it is particularly successful when the electric motor is a D.C. motor, because such a motor has particularly good torque characteristics that can be adapted without difficulty to the requirements of a particular application, and it is also possible for the braking torque to be largely independent of the speed. The torque value can be increased by influencing the current or the voltage of the motor.

Thus the electric motor can contain an arrangement for altering the torque, making possible the continuous adjustment of the yarn brake as, for example, in the range between 0 and 150 Milli Newton (mN) a feature that is important in knitting machines.

In a preferred embodiment the yarn brake utilizes of an essentially cylindrical drum body carrying a number of elongated stirrups that are evenly distributed around its circumference at equal radial distance from the drum axis. These stirrups run mainly in the direction of the drum axis, and at least one of their two ends is fastened to the drum body, while those parts that form the yarn contact section are at a radial distance to the drum body.

This yarn drum is characterized by an extremely low flywheel effect, so that in conjunction with a stepping motor drive it is possible to operate with precision in stop-and-go fashion without encountering inadmissible tension peaks and without even short-term loss of yarn tension.

The stirrups can be designed in essentially L- or U-fashion and can be fastened to the drum body by the first stirrup legs that run in a roughly radial direction. Preferably they have a second stirrup leg on the side opposite the first leg, also running in roughly radial direction; the stirrups are laterally and/or radially guided by the second stirrup leg at the drum body. An especially simple arrangement is obtained when the essentially pot or mushroom-shaped drum body contains radial slots in which the second stirrup legs are guided.

To prevent the stirrups from spreading out radially when the yarn drum reaches high speed—which would lead to tensile stress in the yarn windings wrapped around the yarn drum—the stirrups can if necessary be outwardly supported on the side away from the first stirrup leg. It may also be effective for the stirrups to have at least on one side of the yarn contact section a region that broadens radially toward the outside, preventing the yarn windings from falling off the stirrups.

The thin stirrups can be rigidly connected to the drum body, but a particularly effective arrangement is obtained when the stirrups are, at least in some regions, elastic, so that they can be elastically bent slightly inward in radial direction from the contacting yarn windings until they contact the yarn windings with prestress. Thus even with a very small number of windings a slip-free coupling is achieved between the yarn and the yarn drum.

The elastic inwardly directed deflection of the stirrups is effectively controlled by supporting one end of the stirrups with elastic prestress by the drum body or by a part connected thereto.

Preferably the stirrups can be shaped from a thin wire material that can consist of elastic spring wire. In this case their weight would be extremely low, and they would be particularly easy to make. For reasons of weight and easy manufacture it would also be practical if the drum body is made of plastic. Because of the thin, light-weight stirrups the drum body can be designed with very thin walls with the result that the entire yarn drum would have an extremely low flywheel effect.

Because of the rotating stirrups whose yarn contact sections are at a distance from the drum body, an air movement is created during rotation, preventing the accumulation of lint, etc. To increase this effect, it can occasionally be practical for the storage drum to carry fan blades radially within the yarn contact section of the stirrups, with each blade assigned to an air stream that is directed outwardly between the stirrups.

DRAWINGS

DETAILED DESCRIPTION

Figure 1:
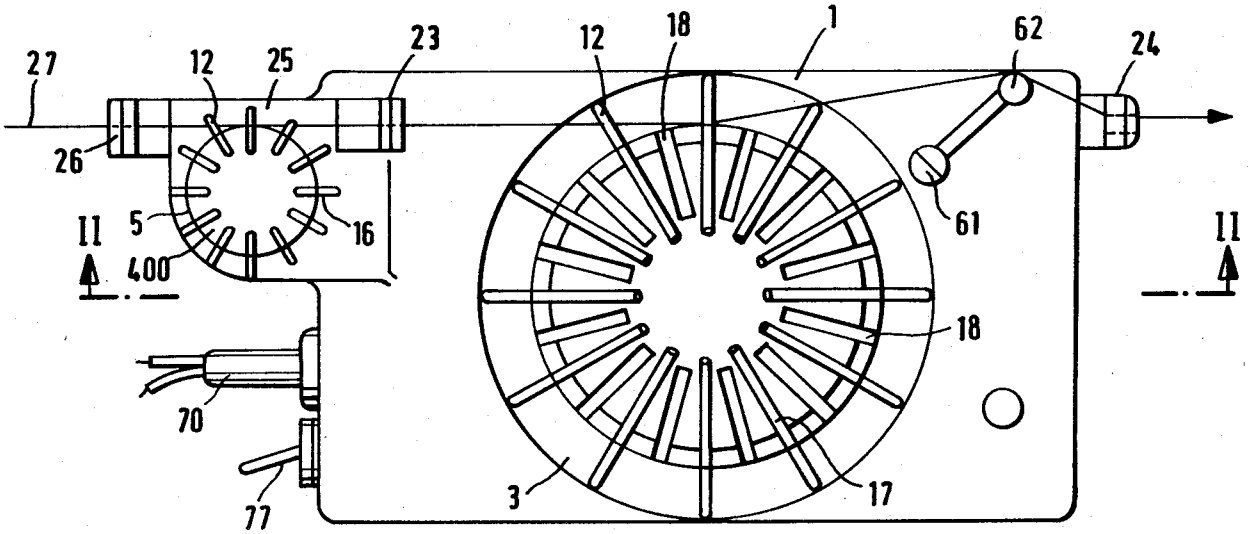
FIG. 1 shows a yarn feeding and storage arrangement with a yarn brake according to the invention, seen in a plan view.
Figure 2:
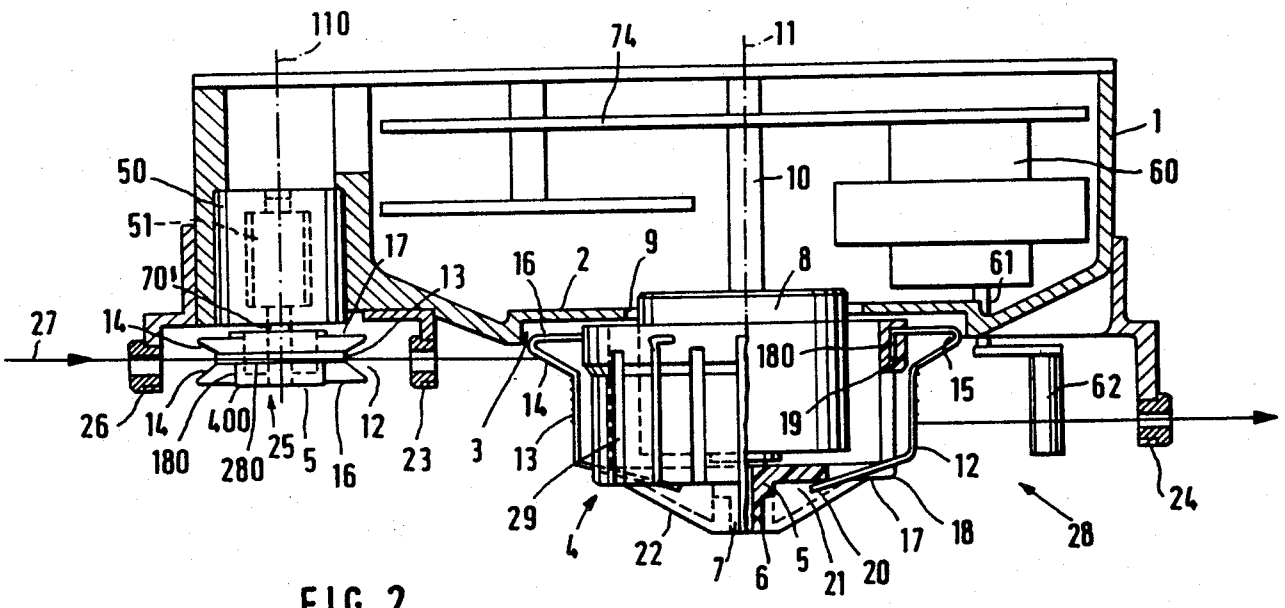
FIG. 2 shows the arrangement according to FIG. 1, cut away along line II—II of FIG. 1, in a side view with partly cut away storage drum of the yarn feeding and storage arrangement.

The yarn brake shown in FIGS. 1 and 2 as number 25 forms part of a self-sufficient yarn feeding and storage arrangement which is hereby briefly explained to facilitate better understanding:

The yarn feeding and storage arrangement includes a holder 1 in the shape of a rectangular, flat housing with parallel sides that can be fastened, for example, to a circular knitting machine, by means of fastening elements not described here in detail. The outside of the level floor 2 of holder 1 has a circular cylindrical cavity 3 into which protrudes a storage drum 4 that is arranged coaxially to cavity 3. The storage drum 4 has an essentially pot-shaped drum body 5 made of plastic that is attached to shaft 7 of an electric stepping motor 8 by means of hub 6. The motor 8 is rigidly connected to holder 1 by fastening element 10 and protrudes through opening 9 in floor 2. Drum body 5 carries a number of stirrups 12 that are evenly distributed around the circumference at an equal radial distance from drum axis 11; the stirrups are shaped from thin spring wire and have smooth surfaces. The spring wire may be of circular or other cross-section, for example angular. It may have the same elasticity throughout the length of the stirrups, but it is also conceivable to have embodiments where each stirrup 12 is made only partly elastic through appropriate hardening of certain regions.

Each elastic stirrup 12 is essentially shaped in the form of a U; parallel to drum axis 11 it has a largely straight yarn contact section 13, followed on the yarn feeding side, i.e. at the top as seen in FIG. 2, by section 14 that is tapered toward the inside; this section 14 ends in arc 15 that eventually turns into the more or less horizontal first stirrup leg 16 running in essentially radial direction in relation to drum axis 11. On the side opposite the first stirrup leg 16, i.e. in the yarn contact section 13, each stirrup also has a second stirrup leg 17 that also essentially runs in radial direction to drum axis 11. The first and second stirrup legs 16 and 17 of all stirrups 12 lie on a common imaginary circular cone coaxially to drum axis 11, while the yarn contact sections 13 of stirrups 12 are on an imaginary circular cone that is also coaxial.

Adjacent to their first legs 16, the stirrups 12 have rectangularly bent fastening elements 180 with which they are embedded in the appropriately broadened mantle 19 of the pot-shaped drum body 5, so that the lateral guidance of the first stirrup legs 16 is ensured in the region of the fastenings.

The second legs 17 of stirrups 12 lie in slots 18 that run radially to drum axis 11; these slots 18 are formed in bottom 20 of drum body 5, and their width is somewhat greater than that of stirrups 12. Thus stirrups 12 are guided laterally in slots 18 via their second stirrup legs 17; they are also supported with axial prestress on support surface 21 on floor 20 of drum body 5, together with their second stirrup legs 17. Thus each of the stirrups 12 is rigidly fastened to drum body 5 near its first leg 16, i.e. at the yarn contact side, while it is guided with radially limited movement along drum body 5 at the other end, i.e. near its second leg 17; the walls of slots 18 guide stirrups 12 laterally in this latter area.

In the vicinity of its floor 20, drum body 5 is designed with cover 22 which is roughly the shape of a truncated cone, into which the slots 18 protrude and which prevents the yarn from becoming entangled in the ends of the second stirrup leg 17.

Laterally to storage drum 4, holder 1 has a stationary yarn filler eyelet 23 and a stationary yarn delivery eyelet 24 as well as a yarn filler eye 26 that is added to yarn brake 25.

The yarn 27 is drawn off a supply coil not described here in detail and runs through filler eye 26 via yarn brake 25 and filler eyelet 23 tangentially to the inwardly tapered sections 14 of stirrups 12 of storage drum 4 driven by stepping motor 8. Because of the inclination of stirrup sections 14, the yarn windings produced there are pushed axially downward, as seen in FIG. 2, into the essentially straight yarn contact section 13 where they form a storage lap, consisting of several yarn windings. Yarn 27 is then drawn off from storage lap 28 and fed to a yarn consumer not described here.

The stirrups 12 can—influenced by the tension exerted by the yarn windings of storage lap 27—elastically move somewhat inwardly about their arc sections 15. The slightly slanted second stirrup legs 17 are prestressed and can slide slightly inwards along support surface 21. This causes the straight yarn contact sections 13 of stirrups 12 to become slightly slanted and to lie on a common cone mantle coaxial to drum axis 11 that promotes the axial advance of storage lap 28.

The elastic resistance offered by stirrups 12 to this inward motion of their yarn contact section 13 depends not only on the elastic properties of stirrups 12 in the region of their "joint" at arc 15, but also on the prestress with which the second legs 17 are supported at support surface 21. When these values are appropriately dimensioned, special characteristics of the yarn material to be wound can be taken into account, if necessary. It is even conceivable that stirrups 12 are designed as rigidly connected with drum body 5, so that they are unable to perform elastic deflective movements.

In mantle 19 and in floor 20 of the pot-shaped drum body 5, between adjacent stirrups 12, slot-like apertures 29 are designed to reduce the already small mass of storage drum 4 even further and also to function as ventilation holes for the revolving storage drum 4, cooling stepping motor 8 and providing openings through which the yarn windings of storage pile 28 are ventilated and blown off toward the outside.

The electromagnetic yarn brake 25 has a D.C. motor inserted into an associated drill hole in holder 1 and carrying a yarn drum 400 having essentially the same design as the above described storage drum. It can also be used directly as the yarn drum of yarn brake 25. That is why identical parts are shown with corresponding reference numbers. The difference is that yarn drum 400 has a smaller diameter than storage drum 4. Its roughly U-shaped stirrups 12 also consist of thin spring wire; on both sides of the largely axially parallel straight yarn contact section 13 they are designed with two radially outwardly tapered sections 14 which ensure that yarn windings in the drum zone 280 (as a rule two or three yarn windings are enough) cannot run off or fall off the yarn contact section 13.

Furthermore, the second stirrup legs 17, contraty to those in storage drum 4, run almost at a right angle to the yarn drum axis 110, while cover 22 can be eliminated.

Yarn drum 400 is fixed against relative rotations on shaft 70 of D.C. motor 50 whose low-inertia armature is indicated as number 51.

The yarn 27 feeding through filler eye 26 is, as already mentioned, wrapped around yarn drum 400 several times and is therefore coupled with it in a slip-free manner. D.C. motor 50 functions as a braking motor and is driven by the running yarn against its impressed sense of rotation, i.e. it has a tendency of driving yarn drum 400 in the opposite rotational direction from that of storage drum 4. But its torque is much lower than that of stepping motor 8, so that it develops a braking torque that acts via yarn drum 400 upon yarn 27 and that ensures that yarn 27 is always wound onto storage drum 4 at a predetermined yarn tension.

The value of this braking torque of electric motor 50 can be permanently determined or constantly controlled by appropriately influencing one of its electrical input quantities (current or voltage), as will be described in detail below.

This braking torque is maintained even when the yarn speed becomes very slow or when yarn 27 comes to a standstill. If for example stepping motor 8 that drives storage drum 4 should be turned off during the adjustment of the knitting machine supplied by the yarn delivery apparatus, and if storage drum 4 should stop exerting pull upon the incoming yarn, the torque exerted by electric motor 50 of yarn brake 25 would be sufficient to drive yarn drum 400—according to its impressed sense of rotation—in the opposite sense and feed back yarn 27 via the filler eye 26 until the piece of yarn running over the now empty storage drum 4 to the yarn consumer has again reached the predetermined voltage, which brings motor 50 and yarn drum 400 to a stillstand. This yarn tension is maintained until storage drum 4 again assumes its normal operation and feeds yarn to the yarn consumer.

Figure 3:
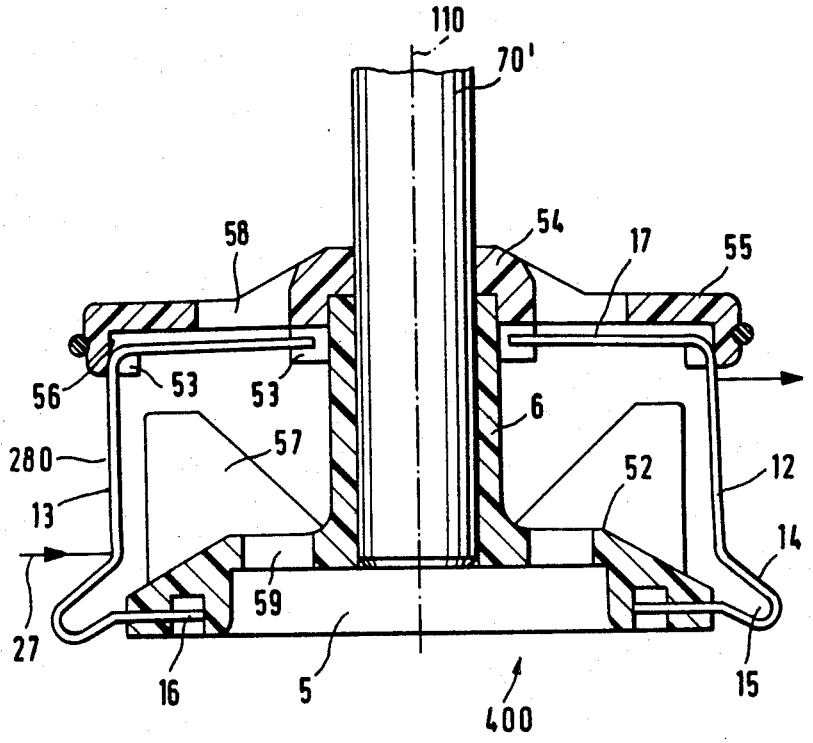
FIG. 3 shows the yarn drum of the yarn brake according to FIG. 1 in a modified embodiment, axially cut away in a side view and drawn to a different scale.

A somewhat modified embodiment of yarn drum 400 is shown in FIG. 3, where the same reference numbers are used where the parts are the same as in yarn drum 400 and in the storage drum shown in FIGS. 1 and 2, so that it is unnecessary to repeat the description.

In this case drum body 5 made from plastic is essentially mushroom-shaped. At its pod-shaped hub 6 by which shaft 70' is fixed against relative rotation, it has a ring flange 52 in which the first stirrup legs 16 of the thin wire stirrups 12 are fastened. For this purpose the first stirrup legs 16 are inserted into groove-like cavities arranged in star-shaped fashion in the face of ring flange 52 in which they are captivated by means of the welded plastic material of ring flange 52. The thus produced embedding of stirrup legs 16 also allows the lateral guidance of the stirrup legs with the result that stirrups 12 cannot be deflected in the rotational direction of yarn drum 400 by the unwinding of yarn 27.

On the other side of the straight, essentially axially parallel yarn contact section 13, around which yarn 27 is wrapped in two or three windings in the drum zone 280, the second stirrup legs 17 running roughly at a right angle to yarn drum axis 110 are laterally guided in radially oriented slots 53 on the inside of support washer 55 that is fixed against relative rotation to shaft 70'. Stirrups 12 are not otherwise connected with drum body 5 in the region of their second stirrup legs 17 and thus are capable of limited radial movement; they are also radially supported toward the outside at a cylindrical support surface 56 of support washer 55, so that they cannot spread outward under the centrifugal force exerted at high speed. Stirrups 12 abut at support surface 56 with elastic prestress that is dimensioned according to the rate of elastic resistance which the elastic stirrups are expected to exert against an inwardly directed deflective movement caused by yarn windings 280.

In the space inside the yarn contact section 13 of stirrups 12, fan blades 57 are arranged on circular flange 52 producing a radially outward-directed air flow that emerges between stirrups 12 and blows over windings 280. Thus lint that may be carried by yarn 27 is removed, and the accumulation of lint at the yarn brake or at associated yarn guidance or conveyance devices is prevented.

The stirrups 12 in this embodiment only have a section 14 that broadens toward the outside, but in principle they could, of course, be equipped in two such sections 14 as in the embodiment of yarn drum 400 shown in FIG. 2.

If the expected rotational speed of yarn drum 400 is so low that a significant effect of the gravitational force on stirrups 12 is not expected, support washer 55 can be eliminated. But in that case it is also conceivable to retain only hub 54 instead of support washer 55 and thus to guide the ends of the second stirrup legs 17 laterally in their slots 53.

The stirrups 12 can also be made of plastic or designed as flat stamped or punched parts that carry parts acting as fan blades on the inside of yarn contact section 13. If the stirrups 12 are made of plastic, they can also be moulded as one piece together with ring flange 52 or support washer 55.

Figure 4:
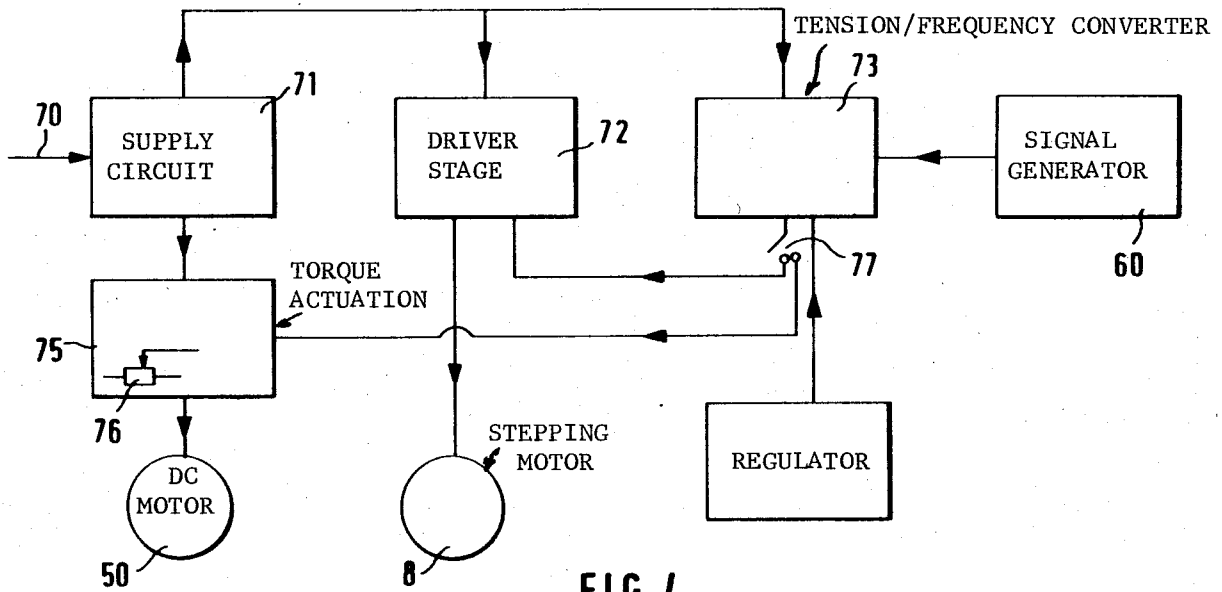
FIG. 4 shows a schematic electrical block circuit diagram of the arrangement according to FIG. 1.

The electric circuit for controlling D.C. motor 50 and stepping motor 8 is schematically shown in FIG. 4: A supply circuit 71 fed by the power mains, or net at 70, feeds D.C. motor 50 and—via a driver or amplifier stage 72—the stepping motor 8 and a tension/frequency converter 73. Holder 1 contains a signal generator 60 that is arranged on a printed circuit board and has a sensor shaft 61 protruding through the bottom of holder 1 and carrying a sensing element 62 that elastically abuts laterally to yarn 27 unwinding off storage drum 4. Sensing element 62 scans the tension of the unwinding yarn 27 and produces the rotational angle of sensor shaft 61 that indicates the actual value of yarn tension. This is compared in signal generator 60 with a predetermined control value. Signal generator 60 produces an analogue electrical tension signal that indicates the deviation between the actual value and the predetermined control value of the yarn tension. The signal is transmitted to tension/frequency converter 73 which transforms it into an appropriate stepping frequency control signal.

In normal operation this stepping frequency control signal is transmitted to driver stage 72 which feeds stepping motor 8 in such a way that the tension of yarn 27 unwinding from storage drum 4 is held at the predetermined control value. Yarn drum 400 of yarn brake 500 is charged by the other D.C. motor 50 with a constant braking torque that is regulated by a torque actuator step. Torque actuator step 75 contains a manually operated actuator element (indicated at number 76) which allows the appropriate adjustment of the yarn winding onto storage drum 4.

For example during adjustment of the knitting machine fed by the yarn delivery arrangement, the drive of storage drum 4 can be turned off by means of switch 77 (FIGS. 1 and 4). The arrangement is designed in such a manner that switch 77 which is constructed as a changeover switch also transmits the signal coming from yarn tension signal generator 60 to torque actuator step 75 of D.C. motor 50 of yarn brake 25 via tension/frequency converter 73. Thus motor 50 of yarn brake 25 assumes the maintenance of the predetermined yarn tension via yarn drum 400.

It is, of course, possible to let yarn brake 25 control its own yarn tension if required, by arranging the associated yarn tension sensor 62 in the yarn path behind storage drum 400.

This applies not only to a yarn brake forming part of a yarn delivery arrangement as described, but to all applications of the yarn brake. In principle it can be used wherever it is necessary to brake a yarn in a defined manner. This is the case not only in yarn processing machines such as knitting, sewing and weaving machines, but also in spooling machines, etc. The yarn brake as described can also include an integrated yarn tension regulator that ensures that the yarn unwinding from yarn drum 400 to the yarn consumer will always have a predetermined yarn tension.

We claim:

1. Yarn brake, particularly for textile machines, having a rotatable yarn drum receiving yarn wrapped several times in a slip-free manner about a yarn contact section, and an electromagnetically operating braking device fixed against relative rotation to the yarn drum for application of braking torque applied upon the yarn drum, comprising, in accordance with the invention, an electric motor (50) having a low-inertia armature (51) coupled to the yarn drum, the electric motor being driven by the moving yarn (27) against its impressed sense of rotation;

an actuator element (75) coupled to the electric motor (50) to alter the torque of the motor;

wherein the yarn drum is a low-inertia yarn drum (400);

a yarn tension sensor (62; 60) is provided for scanning the yarn (27) unwinding from the low-inertia drum (400) and for permitting a signal indicating the yarn tension or its deviation from a predetermined control value; and wherein said signal is coupled to influence the actuator element (75) to alter the torque of the electric motor (50) in the sense of an appropriate adjustment of a predetermined torque.

2. The yarn brake of claim 1, wherein the electric motor (50) is a D.C. motor.

3. The yarn of claim 1, wherein the low-inertia yarn drum (400) comprises an essentially cylindrical drum body (5);

a plurality of thin, elongated stirrups (12) carried on said drum body, evenly distributed around the circumference at equal radial distance from the axis (110) of the drum body, and positioned mainly parallel to the axis of the drum, said stirrups having a yarn contact section (13) positioned at a radial distance from the drum body (5).

4. The yarn brake of claim 3, wherein the stirrups (12) comprise essentially L or U-shaped elements, secured to the drum body (5) by a first stirrup leg (16) extending in generally radial direction.

5. The yarn brake of claim 4, wherein the stirrups (12) are essentially U-shaped and have a second leg (17) extending in essentially radial direction axially spaced from the first stirrup leg (16) towards the drum body;

and wherein the stirrups (12) are guided with their second stirrup leg in at least one of: radial direction; lateral direction.

6. The yarn brake of claim 5, wherein the drum body (5) is essentially pot or mushroom-shaped, and formed with radial slots (18), said second stirrup legs being guided in said radial slots.

7. The yarn brake of claim 4, wherein the stirrups (12) are axially outwardly supported on the drum body (5) on a side thereof remote from the first stirrup leg (16).

8. The yarn brake of claim 3, wherein the stirrups (12) include a yarn contact section (13);

and wherein at least on one side of the yarn contact section a radially outwardly positioned region (14) is defined, which radially broadens towards the outside.

9. The yarn brake of claim 3, wherein the stirrups (12) comprise an at least partly elastic element.

10. The yarn brake of claim 9, wherein the stirrups (12) are elastically pre-stressed and supported with said elastic pre-stress on the drum body (5).

11. The yarn brake of claim 10, wherein the drum body (5) includes a holding element (55) retaining said stirrups thereon in pre-stressed condition.

12. The yarn brake of claim 3, wherein the stirrups (12) comprise thin wire material.

13. The yarn brake of claim 3, wherein the storage drum (400) includes fan blades (57) located radially within the yarn contact section (13) of the stirrups;

and wherein the fan blades (57) are shaped to direct an air stream radially outwardly between the stirrups.

14. The yarn brake of claim 3, wherein the drum body (5) is made of plastic.

* * * * *